US010434670B2

(12) United States Patent
Lev

(10) Patent No.: US 10,434,670 B2
(45) Date of Patent: Oct. 8, 2019

(54) SHAVING APPARATUS

(71) Applicant: SPECIAL CHEMICALS LTD., Holon (IL)

(72) Inventor: Shlomo Lev, Holon (IL)

( * ) Notice: Subject to any disclaimer, the term of this patent is extended or adjusted under 35 U.S.C. 154(b) by 0 days.

(21) Appl. No.: 15/576,821

(22) PCT Filed: May 19, 2016

(86) PCT No.: PCT/IB2016/052939
§ 371 (c)(1),
(2) Date: Nov. 26, 2017

(87) PCT Pub. No.: WO2016/203326
PCT Pub. Date: Dec. 22, 2016

(65) Prior Publication Data

US 2018/0304483 A1 Oct. 25, 2018

Related U.S. Application Data

(60) Provisional application No. 62/180,644, filed on Jun. 17, 2015, provisional application No. 62/209,385, filed on Aug. 25, 2015.

(51) Int. Cl.
*B26B 21/38* (2006.01)
*B26B 21/22* (2006.01)
(Continued)

(52) U.S. Cl.
CPC ..... *B26B 21/38* (2013.01); *B26B 21/225* (2013.01); *B26B 21/4012* (2013.01); *B26B 21/522* (2013.01); *B26B 21/526* (2013.01)

(58) Field of Classification Search
CPC ..... B26B 21/526; B26B 21/522; B26B 19/06; B26B 21/225; B26B 21/38; B26B 19/20;
(Continued)

(56) References Cited

U.S. PATENT DOCUMENTS 4,642,892 A * 2/1987 Ishida ..... B26B 21/38 30/44
5,343,622 A 9/1994 Andrews
(Continued)

FOREIGN PATENT DOCUMENTS

DE 644988 5/1937
GB 2419103 4/2006
(Continued)

OTHER PUBLICATIONS

US 5,815,924 A, 10/1998, Apprille, Jr. et al. (withdrawn)

*Primary Examiner* — Ghassem Alie
(74) *Attorney, Agent, or Firm* — Patshegen IP LLC; Moshe Pinchas

(57) ABSTRACT

A shaving apparatus is provided for shaving hair on a skin surface. The shaving apparatus includes a shaver head having at least one first blade configured to shave hair on a skin surface during displacement of the shaving head in a first direction along the skin surface, and at least one second blade configured to shave hair on the skin surface during displacement of the shaver head in a second direction along the skin surface; and a drive configured to reciprocally slide the first and second blades in an alternating motion between the first direction and the second direction thereby allowing a bi-directionally shaving hair on the skin surface.

22 Claims, 15 Drawing Sheets

(51) Int. Cl.
*B26B 21/40* (2006.01)
*B26B 21/52* (2006.01)

(58) Field of Classification Search
CPC ... B26B 19/382; B26B 21/22; B26B 21/4012; B26B 21/405; B26B 21/4031
USPC .... 30/50, 34.1, 45, 44, 48, 42, DIG. 1, 43.7, 30/77, 84, 827
See application file for complete search history.

(56) References Cited

U.S. PATENT DOCUMENTS

| | | | | |
|---|---|---|---|---|
| 5,522,137 | A | 6/1996 | Andrews | |
| 6,161,288 | A | 12/2000 | Andrews | |
| 2004/0128835 | A1 | 7/2004 | Coffin et al. | |
| 2008/0000089 | A1* | 1/2008 | Pennella | B26B 19/06 30/34.1 |
| 2010/0281694 | A1 | 11/2010 | Royle | |
| 2013/0160296 | A1 | 6/2013 | Park et al. | |
| 2016/0089800 | A1* | 3/2016 | Coresh | B26B 21/38 30/45 |

FOREIGN PATENT DOCUMENTS

| | | |
|---|---|---|
| WO | 2007116397 | 10/2007 |
| WO | 2013153462 A2 | 10/2013 |

* cited by examiner

SHAVING APPARATUS

FIELD OF INVENTION

The presently disclosed subject matter relates to a shaving apparatus, in general, and in particular to a shaving apparatus for shaver having multiple razor blades.

BACKGROUND

Shaving is a mechanical action whereby the razor blade cuts the hair bristle from the skin. Many different types of shavers have been developed, starting with the straight-razor, where the blade is sharpened along the length of the mouth of the device, and is an integral part of the straight-razor itself.

A disposable razor or replicable razor such as a safety razor is typically constructed such that the blade is located between two sides of the shaver, such that only the blade of the razor protrudes from the top surface thereof. Recently, both a tin edge razor dual blade razor and a triple-edged razor or more have been developed, as disclosed for example in U.S. Pat. No. 5,815,924, in which two or more blades are arranged such that the blades are situated parallel to each other and in diagonally to each other, such that the blade edges create an acute angle between the blades and skin surface, thereby shaving each hair bristle sequentially.

When the blade of the razor is operated counter to the direction of the hair growth, then the blade only cuts the hair on the surface. With a double or triple edged razor, the first blade cuts the hair bristle on the surface and then pulls the hair from the follicle, while the second blade cuts the remainder of the hair bristle and so forth. However, if the direction of the hair growth is in the direction of the motion of the razor blade, then the first blade flatten the hair on the skin and cuts the bristle while leaving the stub bristle protruding from the surface of the skin, while the following blades only manage to cut the hair slightly, leaving the hair bristle protruding on the surface. A single-edged razor is therefore even less effective for delivering an even, smoothly shaved surface. This problem would be further exacerbated after continuous use and wear of the razor.

It is noted however, that the disclosed razor requires a complicated arrangement which is further beleaguered by latent deficiencies of awkward manipulation requirements by the user in order to operate the razor. The bristles of hair grow from follicles which are located in a layer of skin known as the epidermis. Hair, such as facial hair, is arranged such that in certain areas, the bristles are perpendicular to the surface of the skin and in other areas, the bristles grow in different angles. Thus, the bristles of hair may not be present at a perpendicular angle to the skin. That is to say, hair bristles grow from hair follicle which extends inside the dermis and the epidermis with an angle with respect to the skin surface. The angle can be different that 90 degrees, such that the hair bristles projecting from the hair follicle is in different direction and different angles. Shaving bristles with a razor however requires that the razor is displaced over the skin surface in a direction opposing the growing direction of the hair, i.e. from the direction where the angle between the hair and the skin surface is an acute angle. This way, the hair is cut from the closest portion thereof to the skin surface. It is thus desirable to displace the razor over the skin surface in various directions.

Accordingly, when razors of the above mentioned kinds are used, the razor must be held in various orientations, and the user must change the way and the direction the razor is held a few times during the shaving process in particular when the counter of the skin surface includes curves.

U.S. Pat. Nos. 5,343,622 and 5,522,137 disclose another manifestation of the concept of using one or more razors, such that a plurality of pairs of razors are arranged such that each pair of blades is outwardly oriented, creating a dull angle between the edges of the blades. This arrangement enables the razor to be moved, manually, back and forth on the surface of the skin. This up-and-down movement creates a situation in which during the upward motion, the first pair of blades cuts the hair bristle while the second pair glides on the surface without contact. As the razor is being pulled over the skin surface, the second pair of blades cuts, while the first pair glides on the surface of the skin.

WO2007/116397 discloses a safety razor head blade system using a bi-directional shaving device which eliminates the need for safety edges, thereby providing a slimmer, flatter device. The shaving device enables bi-directional shaving without the need to lift the shaving device from the skin. The device comprises at least two cutting razor blades with the cutting edges thereof substantially internally directed so as to face one another at minimal proximity therebetween.

It is known that substantial discomfort may be caused to individuals attempting to perform a bi-directional shave with a standard shaving apparatus.

Instead, a standard shaving apparatus can be comfortably operated only in a single direction, which is clearly inefficient and limited. Thus, in certain areas, where the blade has traveled in an opposing direction to the hair growth, the area of skin is smooth and without hair bristles on the surface, whereas in the areas where the blade has traveled in the same direction as the hair growth, there are leftover hair bristles and the surface of the skin is not smooth. In order to receive a closer, more complete shave in these areas, the direction of the shaver must be manually changed during the shaving process in order to re-shave the areas in which the hair bristles remained.

There is therefore a need for a shaving apparatus which facilitates bi-directional shaving while being displaced uni-directionally, thereby alleviating the need for complicated arrangements of razor blades or for the alteration of the positioning of the grip by the hand which is holding the handle of the razor.

SUMMARY OF INVENTION

There is provided in accordance with an aspect of the presently disclosed subject matter a shaving apparatus for shaving hair on a skin surface. The apparatus includes a shaver head having at least one first blade configured to shave hair on a skin surface during displacement of the shaving head in a first direction along the skin surface, and at least one second blade configured to shave hair on the skin surface during displacement of the shaving head in a second direction along the skin surface. The apparatus further can include a drive configured to reciprocally slide the first and second blades in an alternating motion between the first direction and the second direction thereby allowing a bi-directionally shaving hair on the skin surface.

This way, the shaving apparatus of the presently disclosed subject matter bi-directional shaving of hair bristles over the skin surface projecting in various direction while displacing the shaving apparatus in one direction over the skin surface and without the having to lift the shaving device from the skin surface.

The at least one first blade can include two first blades and at least one second blade can include two second blades, wherein the two first blades and two second blades are mounted on a blade mount configured to slide back and forth with respect to the shaver head.

A longitudinal edge of the first blades and of the second blades defines a shaving surface and wherein the first blades and the second blades can be mounted at opposing angles with respect to the shaving surface.

The first and second blades can be disposed in parallel to one another and can be set such that the blade edges thereof can be facing one another.

The first and second blades can be disposed in parallel to one another and can be set such that the blade edges thereof can be opposing one another. The drive can include a flexible cable shaft. The drive can be configured for continuously transferring a rotational motion of the flexible cable shaft to the shaver head.

The flexible cable shaft can be coupled to a motor encased in a housing and wherein the shaver head can be articulately coupled to the housing by a joint including a hexagonal surface having a plurality of facets, configured to engage a corresponding seat on the shaver head, such that rotation of the flexible cable shaft causes the rotation of the seat, while allowing tilting of the shaver head with respect to the housing.

The drive can include a drive mechanism configured for rotary to linear motion conversion, and for reciprocally displacing the blades back and forth. The drive mechanism can include a base portion, and a blades mount configured for mounting thereon the first and second blades wherein the blade mount can be configured to slide back and forth over the base portion along a first axis, and wherein the blade mount can be eccentrically coupled to a rotating shaft.

The rotating shaft can be coupled to the joint and can include an eccentric pin rotationally coupled to the blade mount, wherein the eccentric pin can be defined on an axcan be parallel to an axis of the joint such that while the joint can be rotated, the eccentric pin can be displaced about a rotating path.

The blades mount can include a groove defined along a second axis perpendicular to the first axis and a sliding member slidably mounted inside the groove, wherein the sliding member is coupled to the eccentric pin of the rotating shaft, such that when the eccentric pin can be rotated about along the rotating path the sliding member is urged to be displaced therewith along the second axis and the blades mount can be urged be displaced along the first axis.

The blades mount can be coupled to the eccentric pin by a rotating arm wherein the rotating arm can be coupled to the blades mount at a location shifted from the center thereof, with respect to the first axis such that when the rotating arm is rotated the blades mount is urged back and forth along the first axis.

The driving mechanism can include a sliding member having a groove defined along a second axis perpendicular to the first axis, wherein the blades mount can include a protrusion slidably mounted inside the groove, and wherein the sliding member is coupled to the eccentric pin of the rotating shaft, such that when the eccentric pin is rotated about along the rotating path the sliding member is urged to be displaced therewith along the second axis and the blades mount is urged be displaced along the first axis.

The eccentric pin can include a first and a second eccentric pins, wherein the first eccentric pin defined on a first side cogwheel and being coupled to a first side of the sliding member, and a second eccentric pin defined on a second side cogwheel and being coupled to a second side of the sliding member, wherein the first side and second side can be defined along the second axis. The first and second side cogwheels can be simultaneously rotated by a rotating shaft having a cogged portion.

The drive mechanism can includes: a sliding member on which the first and second blade can be mounted, the sliding member can be configured to slide between the first direction and the second direction; a rotating disk eccentrically coupled to a shaft of a motor such that when the shaft can be rotated the rotating disk can be displaced along a rotational path; a bearing engaged with a first end of the sliding member and with a periphery of the rotating disk wherein the periphery can be defined at varying distances from the shaft, such that when the rotating disk can be rotated along the rotating path, the bearing can be pushed in a first direction towards the sliding member; an abutting member engaged with a second end of the sliding member and configured to urge the sliding member in a second direction opposite the first direction, such that the sliding member can be slid back and forth.

The shaving apparatus can further include a housing having an ergonometric surface configured a palm grip.

The shaver head can include an engaging portion configured to engage a skin surface while the drive mechanism displaces the first and second blades back and forth, such that the skin surface can be held in place, with respect to the shaver head.

The engaging portion can include a strip defined on an outer surface of the shaver head alongside the first and second blades such that the strip can be engaged with the skin surface while shaving. The engaging portion can include a first engaging portion disposed adjacent the first blades and a second engaging portion disposed adjacent the second blades.

The first engaging portion can be configured to provide a lower friction than the second engaging portion, such that when the shaver head can be slid in a direction of the first engaging portion the second engaging portion holds the skin surface in place while the first engaging portion stretches the skin in the direction of displacement of the shaver head.

Properties of the alternating motion can be adjusted.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

There is provided in accordance with an aspect of the presently disclosed subject matter a shaving apparatus for shaving hair on a skin surface. The apparatus includes a shaver head having at least one first blade configured to shave hair on a skin surface during displacement of the shaving head in a first direction along the skin surface, and at least one second blade configured to shave hair on the skin surface during displacement of the shaving head in a second direction along the skin surface. The apparatus further includes a drive configured to reciprocally slide the first and second blades in an alternating motion between the first direction and the second direction thereby allowing a bi-directionally shaving hair on said skin surface.

This way, the shaving apparatus of the presently disclosed subject matter bi-directional shaving of hair bristles over the skin surface projecting in various direction while displacing the shaving apparatus in one direction over the skin surface and without the having to lift the shaving device from the skin surface.

Figure 1A:
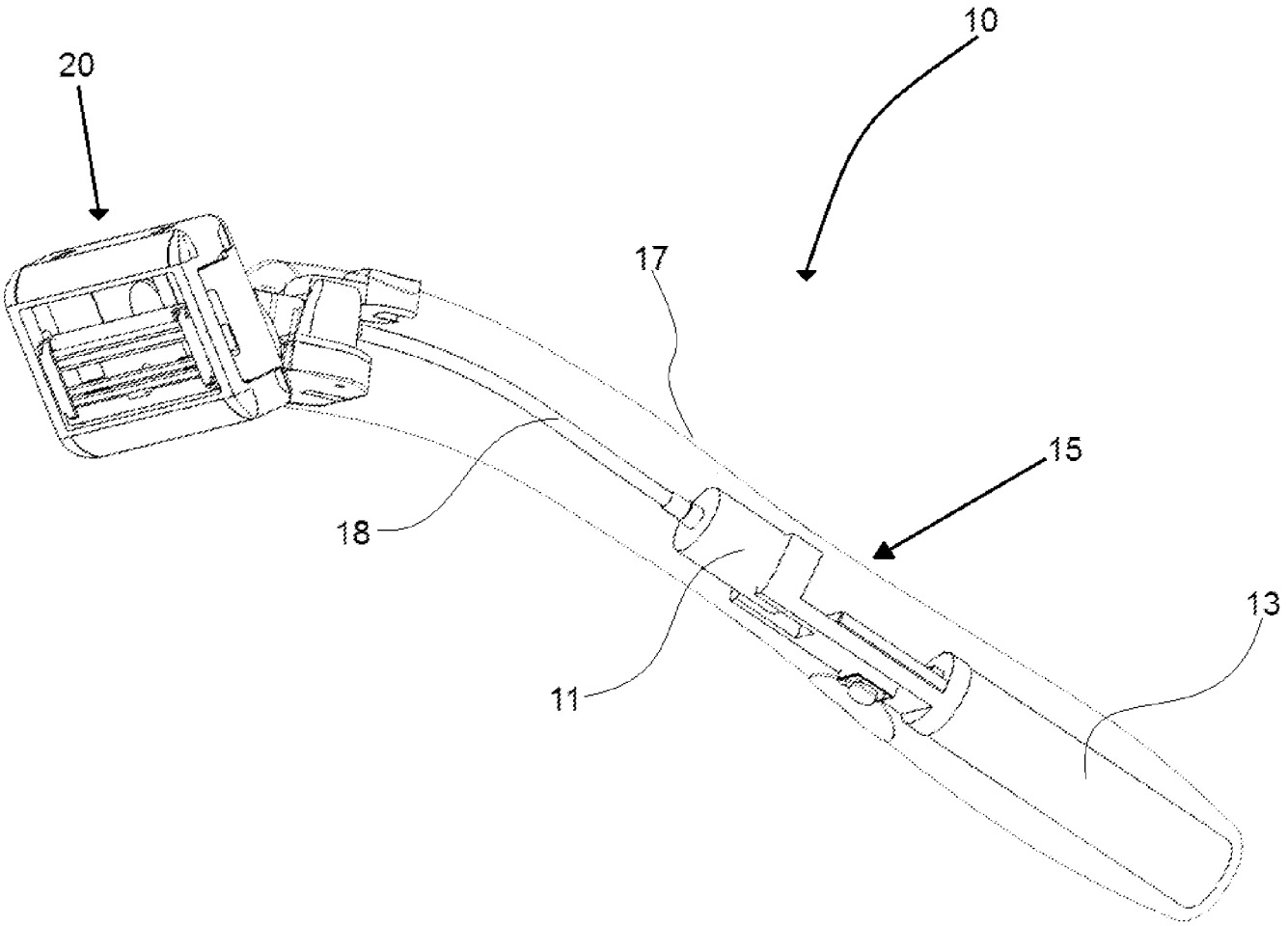
FIG. 1A is a partially transparent perspective view of a shaving apparatus in accordance with an example of the presently disclosed subject matter.
Figure 1B:
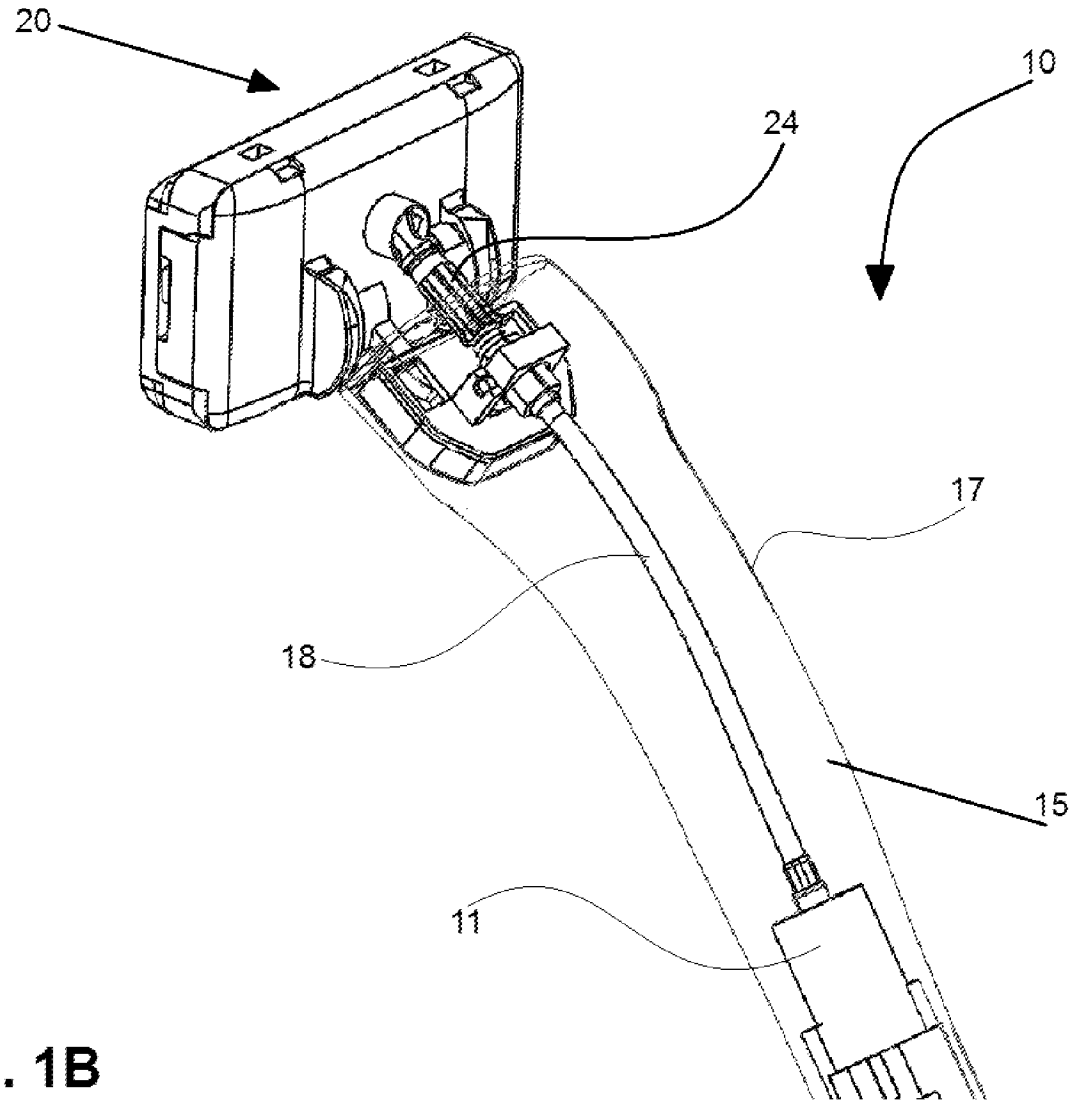
FIG. 1B is a back perspective view of a shaver head of the shaving apparatus of FIG. 1A.

FIGS. 1A and 1B show an example of a shaving apparatus configured for a reciprocal motion of a bi-directional blades arrangement allowing thereby a bi-directionally shaving hair on a skin surface.

The apparatus 10 includes a shaver head 20 configured for a bidirectional shaving of hair and is displaceable in alternating directions with respect to the shaving apparatus, such that the shaving apparatus can be displaced in one direction while the shaver head is displaced in alternating directions. The alternating direction motion of the shaver head is configured to allow shaving hair growing on the skin surface in various directions.

The shaving apparatus 10 includes a housing 15 configured for housing a drive 11, such as an electric motor for the reciprocal driving of the blades as explained hereinafter, and a power source 13, such as rechargeable battery. The housing 15 can be configured such that the outer surface 17 thereof provides an ergonometric grip allowing the user to comfortably hold the shaving apparatus 10 while shaving.

The drive 11 is configured to rotate a rotating shaft 24, which is discussed in detail hereinafter. According to an example, the drive 11 is coupled to the rotating shaft 24 by a flexible cable shaft 18 which is configured to transfer the rotating movement of the drive 11 to the rotating shaft 24. The housing 15 can include a curved surface, i.e. without a straight axis between the axis of the drive 11 and the axis of the rotating shaft 24. This way, the housing 15 can be designed with an ergonometric outer surface facilitating the grip of the apparatus 10.

Figure 2A:
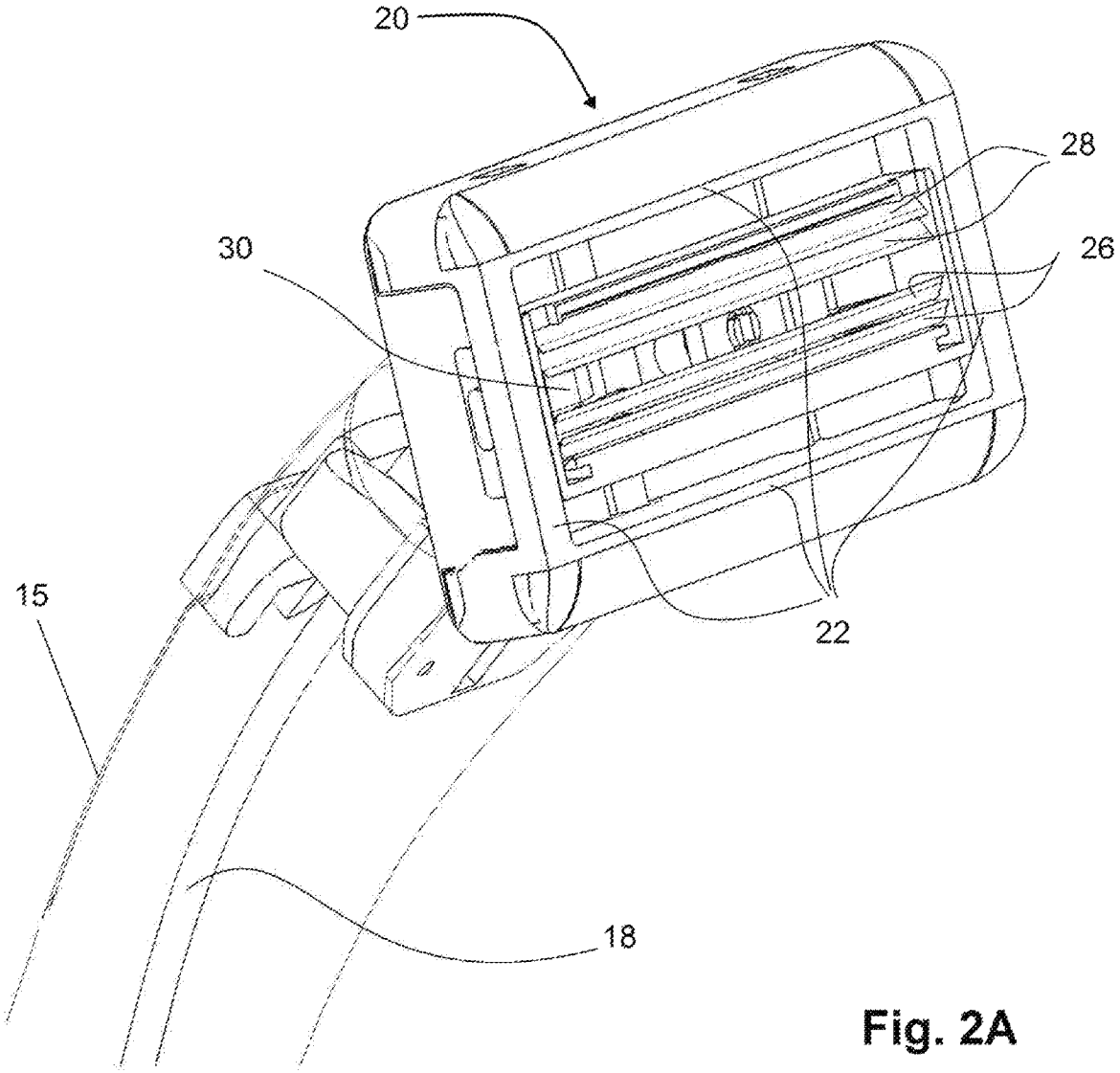
FIG. 2A is a front perspective view of the shaver head of the shaving apparatus of FIG. 1A.
Figure 2B:
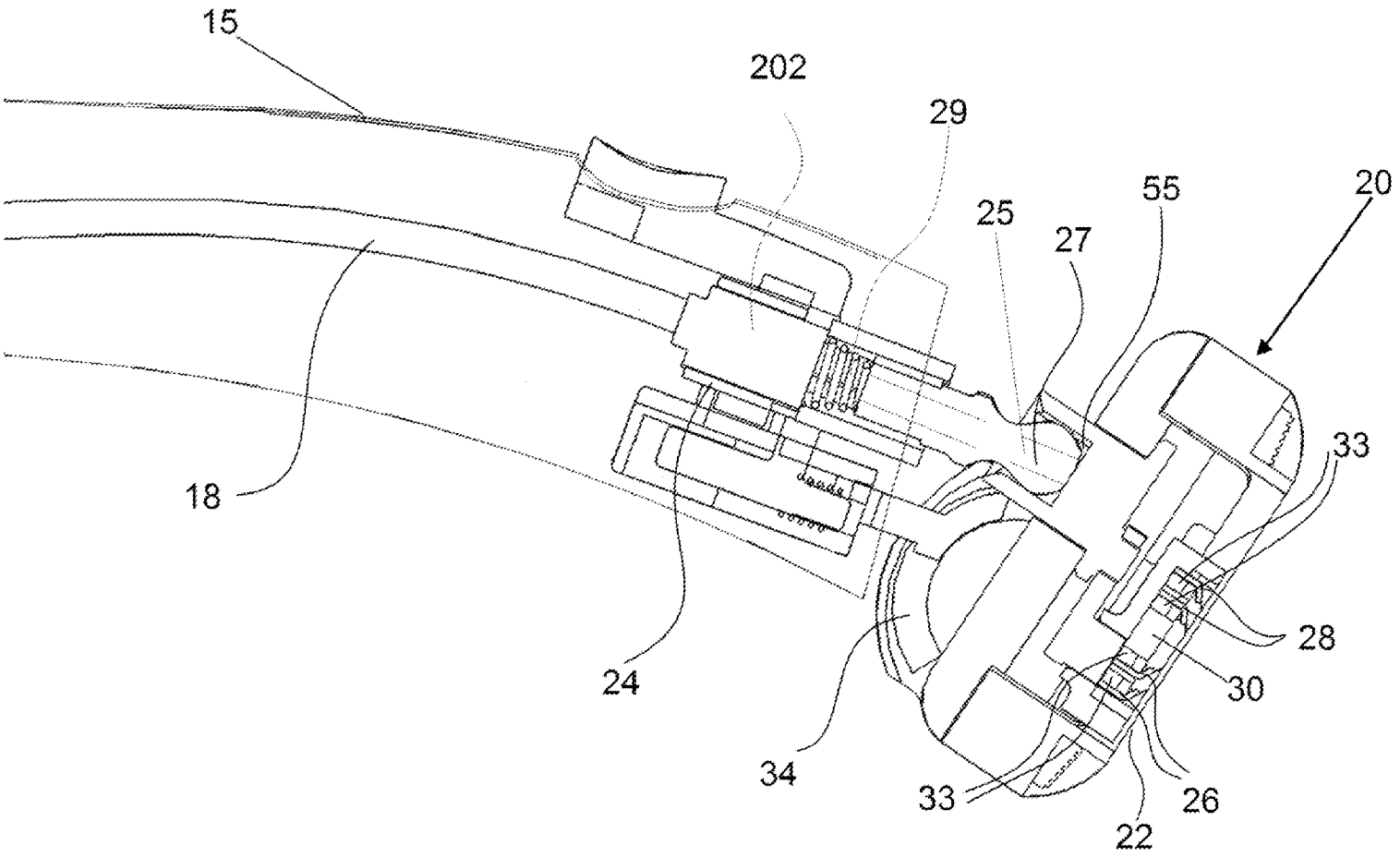
FIG. 2B is a side sectional view of the shaver head of FIG. 2A.

As shown in FIGS. 2A and 2B, the shaver head 20 includes at least one first blade 26 and at least one second blade 28 attached to the shaver head 20. The first blade 26 and the second blade 28 are mounted such that longitudinal edge thereof forms a shaving surface 22.

According to the illustrated example, the shaver head 20 includes a blade mount 30 configured for firmly holding the first and second blades 26 and 28. The blade mount 30 can include for example support arms 33 each configured for supporting one of the blades 26 and 28 thereto, as most clearly shown in FIG. 3B.

As shown in the FIGS. 2A and 2B, the present example includes two first blades 26 and two second blades 28 such that each set of the twin blades performs a more efficient shave.

The first blade 26 and the second blade 28 are mounted at opposing angles with respect to the shaving surface 22 of the shaver head 20, facilitating thereby the shaving of hair on the skin surface. That is to say, the first blade 26 is disposed such that displacement thereof in a first direction along the skin surface shaves hair on the skin surface. Similarly the second blade 28 mounted on the blades mount 30 such that displacement thereof in second direction along the skin surface shaves hair on the skin surface. It is appreciated that the mounting angle of the first blade 26 with respect to the shaving surface 22 of the shaver head 20 can be different or identical to the mounting angle of the second blade 28.

Thus, the blades 26 and 28 are configured to shave hair bristles projecting from the skin surface in opposite direction. The reciprocal motion of the blades, allows bi-directionally shaving of hair bristles over the skin surface while the shaving apparatus 10 is displaced in a single direction. In the present illustration, the first and second blades 26 and 28 are disposed in parallel to one another and are set such that the blade edges are facing one another. Alternatively, the first and second blades 26 and 28 can be disposed with an angle with respect to one another.

It is appreciated that in accordance with another example, the blades can be disposed facing away from one another. Since the blades are each configured to shave bristles projecting from the skin surface in opposite direction, the reciprocal motion of thereof, allows bi-directionally shaving of hair bristles over the skin surface while the shaving apparatus 10 is displaced in a single direction.

Reference is now made to FIG. 2B, the shaver head 20 is articulately coupled to the housing 15, such that it can be tilted at least in the direction of shaving so that the shaving surface 22 of the shaver head 20 maintains contact with the skin surface. According to the illustrated example, the shaver head 20 is coupled to the housing 15 with a joint 25, such that the shaver head 20 can be swiveled with respect to the housing 15 allowing the user to adjust the disposition of the shaver head 20. This way, the shaving surface 22 of the shaver head 20 maintains contact with the skin surface at any position, and can be adapted to any contour of the skin surface. The joint 25 is coupled to the motor inside the housing 15 and is configured to rotate thereby, as explained hereinafter.

The joint 25 is coupled to the rotating shaft 24, which as mentioned hereinabove can be coupled to the drive 11 by a flexible cable shaft 18.

The joint 25 can include hexagonal surface having a plurality of facets 27, configured to engage a corresponding seat 55, such that rotation of the joint 25 causes the rotation of the seat 55, while allowing tilting of the joint 25 with respect to the seat 55.

According to an example the joint is coupled to the housing 15 by a spring 29 providing the shaver head 20 with a certain degree of flexibility with respect to the housing 15.

Figure 2C:
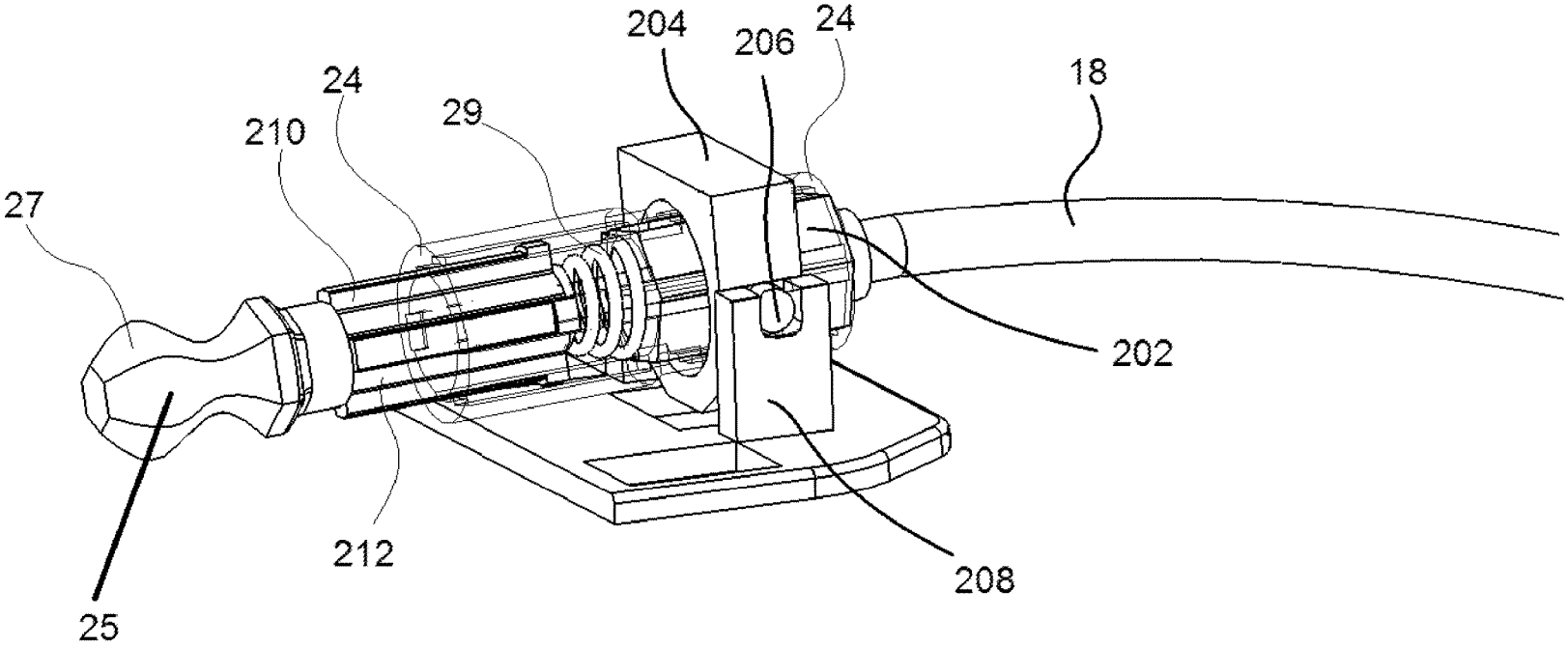
FIG. 2C is a partially transparent side view of the joint of FIG. 2B.

As shown in FIG. 2C, the rotating shaft 24 according to an example is a cylindrical member configured to house therein a coupler 202 mounted on the edge of the cable shaft 18, and a slider 212 coupled to the joint 25. The coupler 202 can include a hexagonal surface for mounting thereof to a corresponding surface inside the rotating shaft 24. The slider 212 includes guides 210 configured to allow sliding thereof inside mating channels defined in the inner surface of the rotating shaft 24. The rotating shaft 24 can further include a spring member 29 disposed between the coupler 202 and the slider 212 and configured to urge the slider away from the coupler 202 and towards the shaver head 20.

The rotating shaft 24, is rotatably mounted inside a bearing 204, mounted inside the housing 15, and thus transfers the rotating motion of the cable shaft 18 to the joint 25 while urging the shaver head 20 away from the housing 15. This way, when the apparatus is in use, the shaver head 20 generally tends to be urged toward the skin surface and to follow the contour thereof.

The spring 29 is configured such that the forces exerted on the shaver head 20 are balanced and the shaving surface 22 is substantially flash with the skin surface.

The bearing 204 can be pivotally mounted inside the housing 15, such that the shaver head 20 can be pivoted while the rotational motion of the rotating shaft 24 is transferred to the joint 25. For example, the rotating shaft 24 can include an axle 206 disposed a corresponding holder 208 coupled to the housing 15. This way, the rotating shaft 24 can be pivoted with respect to the cable shaft 18, while maintaining a continuous rotational motion. As a result the joint 25 can be tilted in three dimensions while maintaining contact with the seat 55 inside the shaver head 20. This allows a continuous rotational movement of the joint 25 despite the varying angles between the shaver head 20 and the skin surface.

The joint 25 thus transfers the rotational motion to the shaver head 20 while allowing the latter to be slightly displaced towards and away the housing 15 as well as to pivot with respect to the housing 15, adjusting thereby the disposition thereof with respect to the skin surface.

The shaver head 20 further includes support guide 34 disposed between the shaver head 20 and the housing 15 and configured to limit the displacement of the shaver head 20 with respect to the housing 15. The support guides 34 can include a rounded surface configured to engage a surface on the housing 15, such that when the shaver head 20 is tilted it is supported by the support guides 34.

The following is an example of a drive mechanism configured for a reciprocal motion of the blades 26 and 28, allowing thereby a bi-directionally shaving of hair bristles over the skin surface while the shaving apparatus 10 is displaced in a single direction.

Figure 3A:
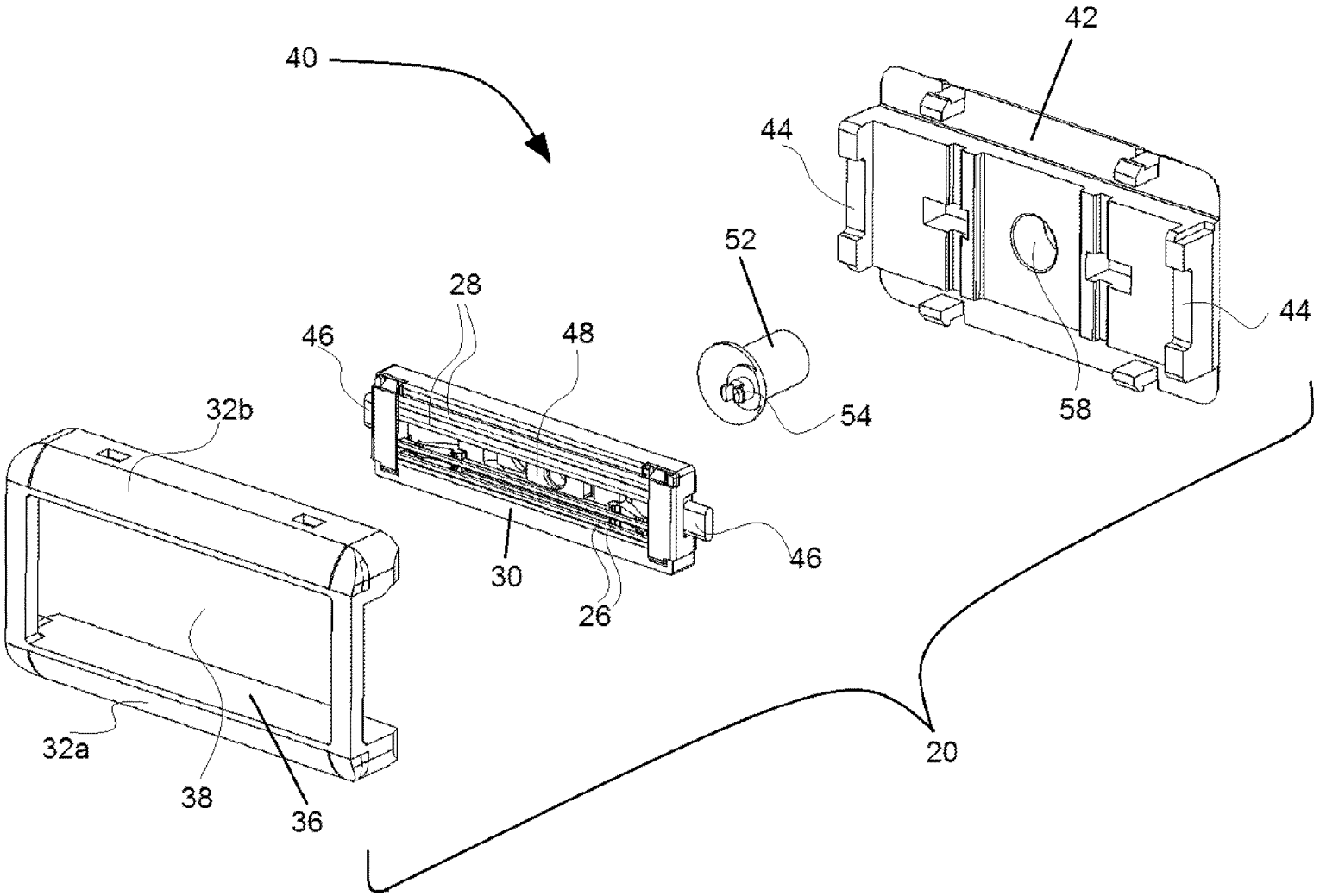
FIG. 3A is an exploded view of the front shaver head of FIG. 2A.
Figure 3B:
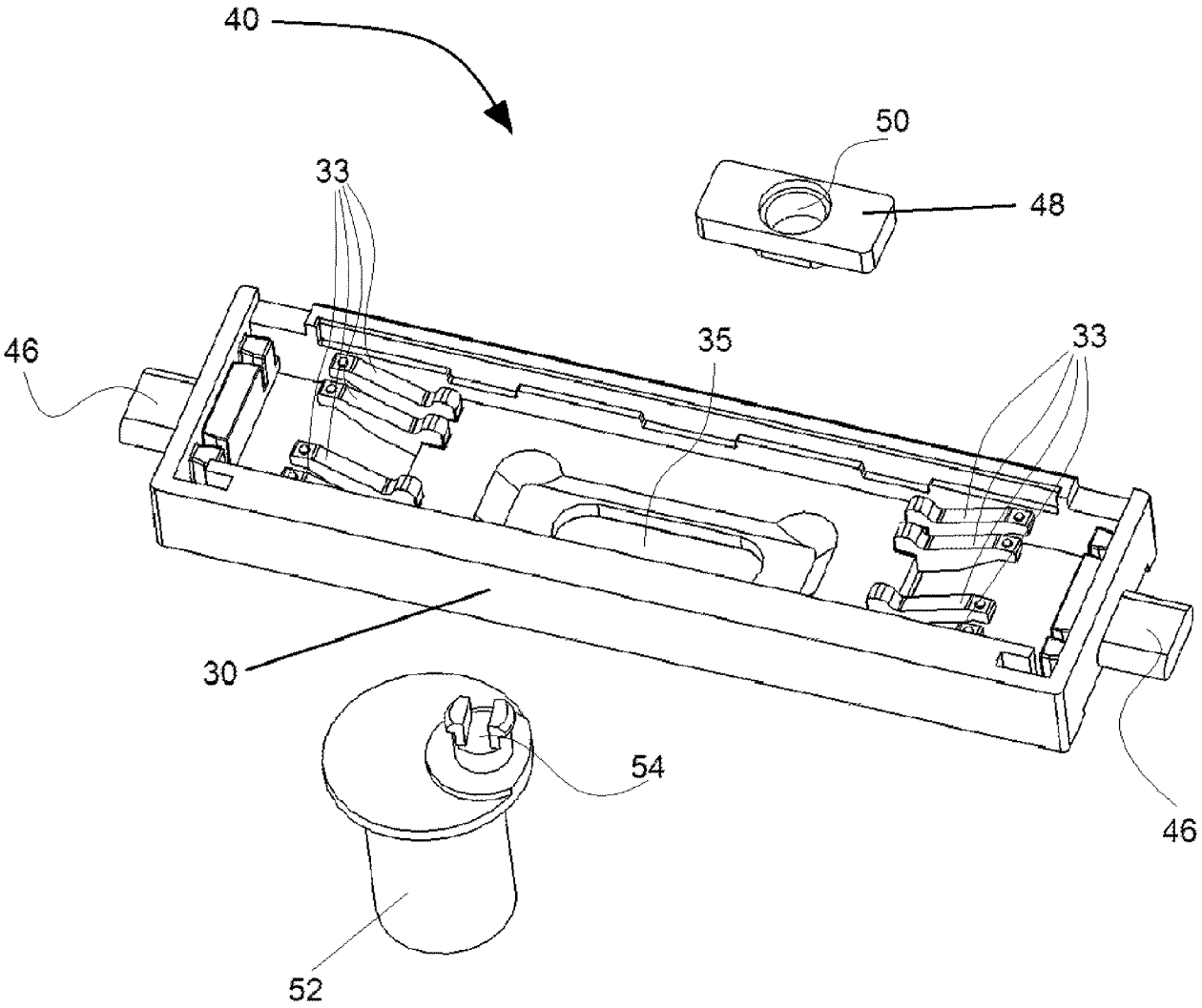
FIG. 3B is an exploded view of the drive mechanism of the saver head of FIG. 2A.
Figure 3C:
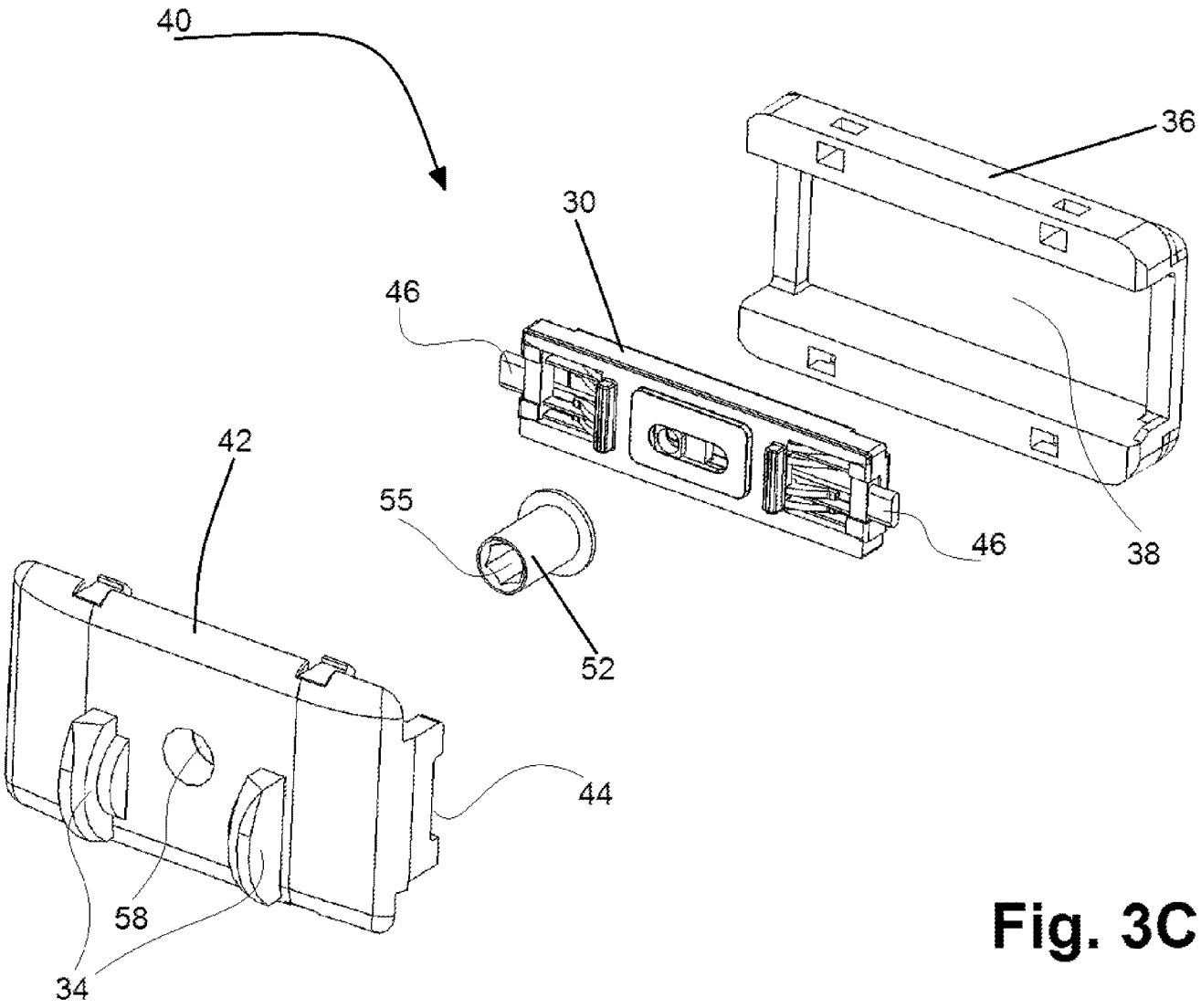
FIG. 3C is an exploded view of the back shaver head of FIG. 2A.

As shown in FIG. 3A to 3C the drive mechanism 40 according to an example, is configured to reciprocally slide the first and second blades 26 and 28 over a portion of the skin surface in an alternating motion between the first direction and the second direction bi-directionally shaving hair on the skin surface. According to the illustrated example, the drive mechanism 40 is configured to reciprocally slide the blades mount 30 such that the first and second blades 26 and 28 are displaced together.

According to an example, the shaver head 20 includes an engaging portion 32 configured to engage the skin surface while the drive mechanism 40 displaces the blade mount 30 and the first and second blades 26 and 28 back and forth. That is to say, the engaging portion 32 is configured to hold the skin surface in place, with respect to the shaving apparatus 10, such that when the first and second blades 26 and 28 are slid along the skin surface, the latter does not displace with the first and second blades 26 and 28. This way, the first and second blades 26 and 28 can slide over the skin surface and shave hairs thereon.

The engaging portion 32 can be a strip defined on an outer surface of the shaver head 20 alongside the first and second blades 26 and 28 such that it engages the skin surface while shaving. For example, the engaging portion 32 can be defined on a cover member 36 of the shaver head 20. The cover member 36 can include an aperture 38, through which the edge of the first and second blades 26 and 28 projects towards the skin surface. This way, during shaving the shaver head 20 is placed on the skin surface such that the cover member 36 engages portions of the skin surface, i.e. the engaging portion 32 is engaged with the skin surface while the blades 26 and 28 are displaced back and forth and engage hairs on the skin surface through the aperture 38. According to an example engaging portion 32 can include a first engaging portion 32*a* disposed adjacent the first blades 26 and a second engaging portion 32*b* adjacent second blades 28. The first engaging portion can be configured to provide a lower friction than the second engaging portion, such that when the shaver head 20 is slide in a direction of the first engaging the second engaging portion holds the skin in place while the first engaging portion slightly stretches the skin in the direction of the displacement of the shaver head 20. Such as disclosed in "USE OF BIOMIMETIC HEXAGONAL SURFACE TEXTURE IN FRICTION AGAINST LUBRICATED SKIN" to Tsipenyuk et al (DOI: 10.1098/rsif.2014.0113)

Stretching the skin surface between the first and second engaging portions facilitates the shaving of hair on the skin surface.

Attention is now directed to FIGS. 3A to 3C, the drive mechanism 40 according to an example, includes a base portion 42, on which the blades mount 30 is configured to slide.

According to an example, the blades mount 30 includes two side arms 46 extending from a side wall of the blades mount 30 and configured to engage a corresponding seat 44 defined on a side wall of the base portion 42. According to an example, the blades mount 30 includes two arms 46 extending from two parallel sides thereof, each being configured to engage a corresponding seat 44 defined on a side wall of the base portion 42. Each of the seats 44 is slightly larger than the respective arm 46, along one dimension of the seat 44 such that the arm 46 can be displaced along that dimension inside the seat 44. This way, the blades mount 30 can be slidably mounted on the base portion 42 such that it can be slid along one dimension thereof.

The blades mount 30 includes a groove 35 along the length of the blades mount 30 such that the groove 35 is perpendicularly disposed with respect to the seat 44, i.e. it is disposed along a dimension which is transverse to the displacement direction of the blades mount 30 with respect to the base portion 42.

According to the illustrated example, the blade mount 30 is configured for firmly holding the first and second blades 26 and 28. The blade mount 30 can include for example support arms 33 each configured for supporting one of the blades 26 and 28 thereto.

The drive mechanism 40 further includes a sliding member 48 configured to be slidably mounted inside the groove 35, i.e. the size of the sliding member 48 is smaller than the length groove 35 in one dimension such that it can slide along the length of the groove 35. The sliding member 48 includes an aperture 50 configured to be coupled to a female shaft 52. The female shaft 52 is coupled to, or integrally formed with, the seat 55, such that the joint 25 provides a rotating movement thereto. It is noted that the female shaft 52 is configured to be extend through a bore 58 defined on the base portion 42, such that the joint 25 can be disposed inside the seat 55.

The female shaft 52 includes an eccentric pin 54 mounted thereon, defined on an axis parallel to the axis of the seat 55, such that one end of the female shaft 52 can be coupled to the joint 25 while the eccentric pin 54 protrudes from an opposing end of the female shaft 52.

As indicated above the eccentric pin 54 is defined on an axis parallel to the axis of the seat 55, such that while the female shaft 52 is rotated with the joint 25 about the axis of the seat 55, the eccentric pin 54 is displaced about a rotating path defined by the periphery of the female shaft 52.

The eccentric pin 54 is configured to be mounted inside the aperture 50 of the sliding member 48, for example by snap fit coupling, such that when the female shaft 52 the sliding member 48 is displaced therewith.

Thus, when the female shaft 52 is rotated and the eccentric pin 54 is rotated about a rotating path the sliding member 48, is urged to be displaced therewith. The engagement of the sliding member 48 and the groove 35, however, limits the movement of the sliding member 48 such that it can only slide inside the groove 35. It is appreciated that since the eccentric pin 54 is rotated about a rotating path in a close loop the sliding member 48 slides in a reciprocating motion, i.e. back and forth displacement along the groove 35.

It is appreciated that since the sliding member 48 slides only along one axis, i.e. the axis of the groove 35, while the eccentric pin 54 is rotated about a rotating path, defined on a plan of two axes, the rotation of eccentric pin 54 urges the blades mount 30 to be displaced along an axis perpendicular to the axis of the groove 35, i.e. the axis of the seats 44 defined on the base portion 42. This way the eccentric pin 54, the sliding member 48, and the blades mount 30 provide a rotary to linear motion conversion, in which the rotating motion of the female shaft 52 is converted to a linear motion in two axes, i.e. displacement of sliding member 48 along the axis of the groove 35, and displacement of the blades mount 30 along the axis of the seats 44.

As a result, when the shaving apparatus is activated, the motor rotates the female shaft 52 causing thereby the blades mount 30 to slide back and forth over the base portion 42, such that the first and second blades 26 and 28 slide back and forth in an harmonic motion.

The first and second blades 26 and 28 can be disposed on the blades mount 30 such the first blades 26 is configured to shave hair on a skin surface during displacement of the shaver head 20 in a first direction along the skin surface. Similarly, the second blades 28 are so disposed on the blades mount 30 such they are configured to shave hair on the skin surface during displacement of the shaver head 20 in a second direction along the skin surface. This way, when the blades mount 30 can be configured to reciprocally slides in an alternating motion between the first and second directions thereby allowing a bi-directionally shaving hair on the skin surface.

It is appreciated that by using the shaving apparatus of the present invention, the user displaces shaving apparatus 10 in any desired direction along the skin surface, while the harmonic displacement of the blades mount 30 results in a reciprocal movement of first and second blades 26 and 28 and allows a bi-directional shave.

It is appreciated that the harmonic motion of the first and second blades 26 and 28 can be characterized in accordance with the motion required for providing an optimal shaving.

It is appreciated that the harmonic motion of the drive can be configured such that the amplitude of the motion of the first and second blades allow shaving of hair on the skin surface by either the first blade 26 or the second blade 28. That is to say the distance of displacement in a first direction as well as the distance of displacement in a second direction can be determined in accordance with the properties of the hair to be shaved.

For example thick and short hair might be shaved best with a harmonic motion having a short amplitude, i.e. the reciprocal displacement in either direction is short. It is appreciated that the distances between the first blade 26 and the second blade 28 can also be determined in accordance with the properties of the hair to be shaved.

It is appreciated that other properties of the alternating motion can be adjusted, for example by an electronic controller configured to automatically adjust the harmonic motion, or a controller which can be adjusted by the user. Adjustment of the harmonic motion, can be in accordance with the hair and skin properties etc.

According to an example the harmonic motion of the first and second blades 26 and 28, as and/or the disposition thereof can be selectively set by the user. This can be carried out by electronic or mechanical means controlling the motion of the drive or the disposition of the first and second blades with respect to one another.

Figure 4A:
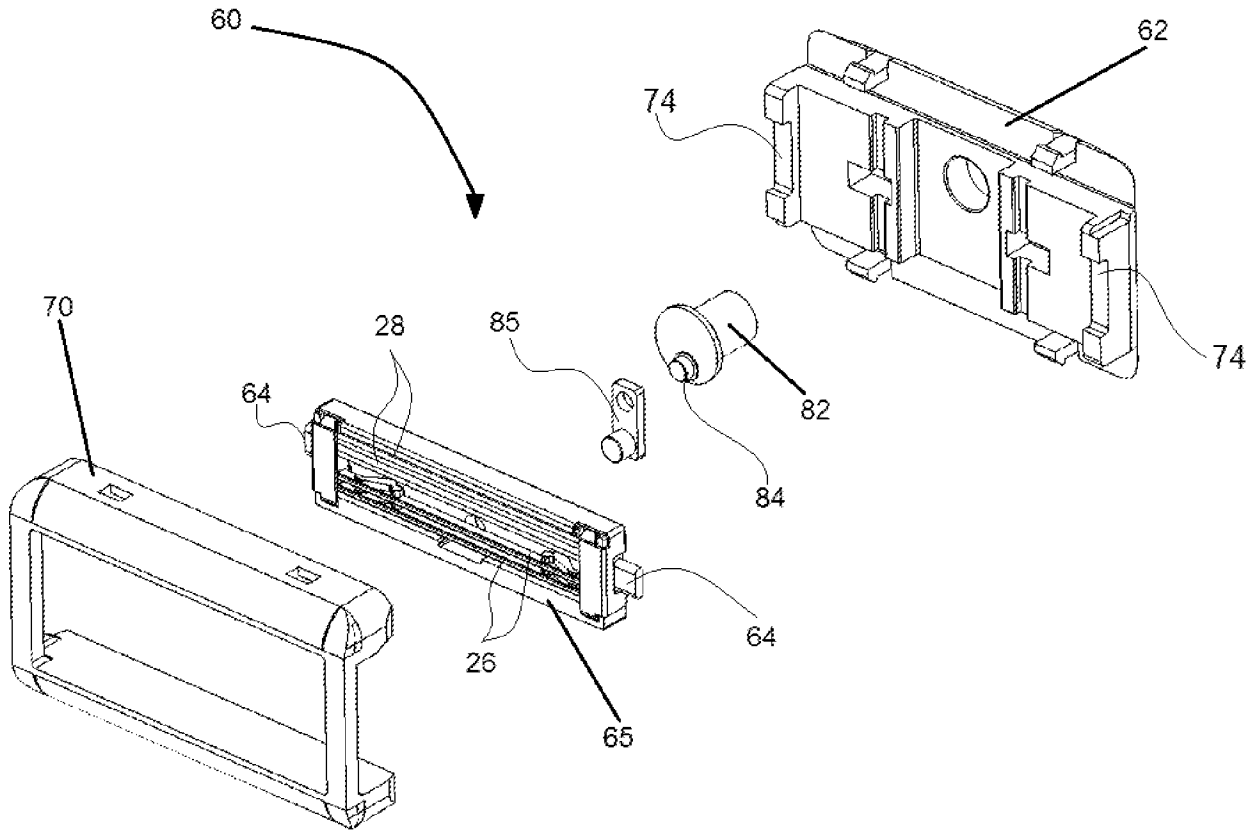
FIG. 4A is a front exploded view of a shaver head in accordance with another example of the presently disclosed subject matter.
Figure 4B:
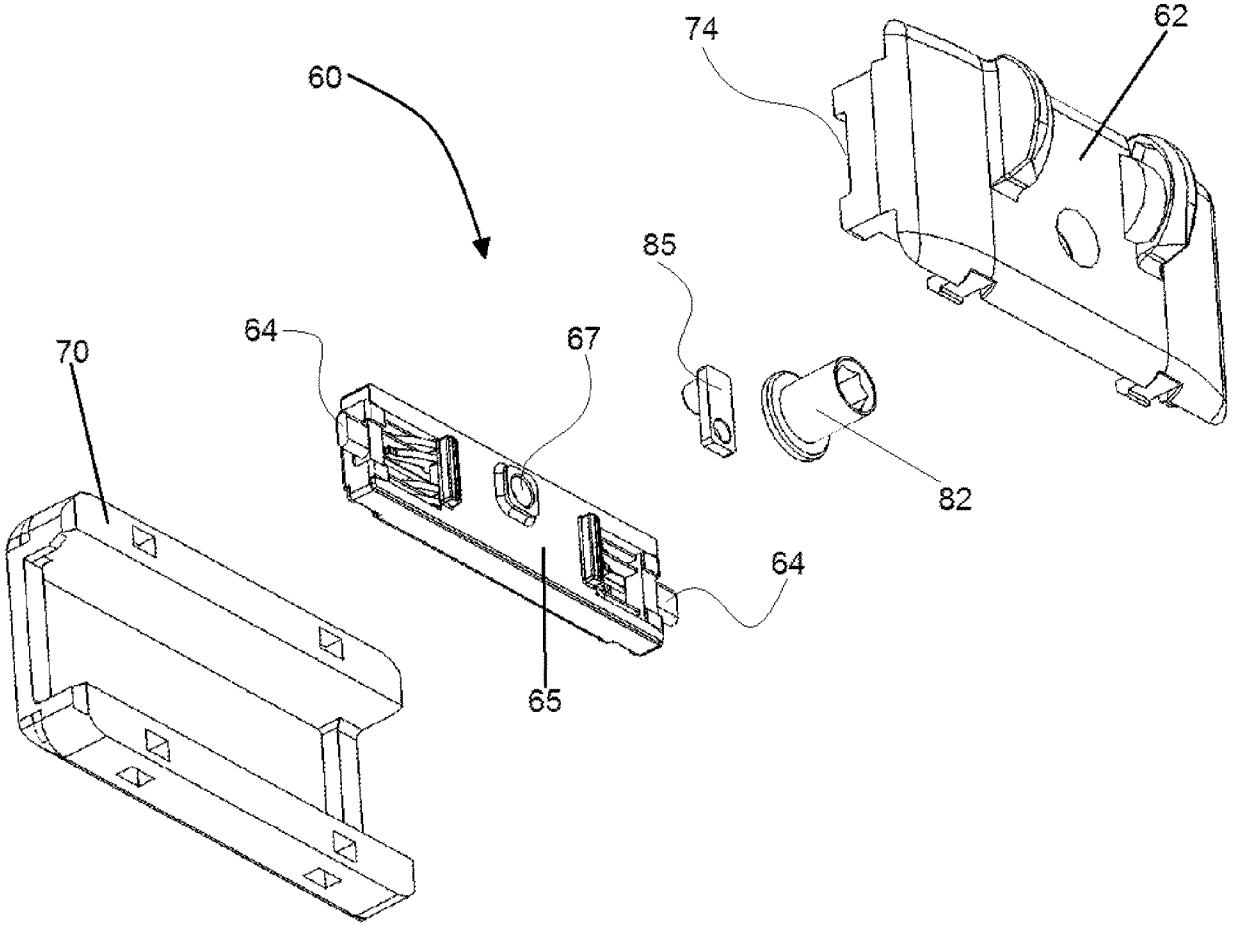
FIG. 4B is a back exploded view of the shaver head of FIG. 4A.

FIGS. 4A and 4B illustrates a drive mechanism 60 for sliding the first and second blades 26 and 28 in an alternating motion between the first and second directions in accordance with another example of the presently disclosed subject matter.

Drive mechanism 60 is substantially the same as drive mechanism 40 of the previous example and includes a base portion 62, a cover portion 70 configured for engaging the skin surface, and a blades mount 65 slidably mounted on the base portion 62. According to the present example, the blades mount 65 includes side arms 64 configured to slide inside depressions 74 defined of two sides of the base portion 62. This way, the blades mount 65 can slide with respect to the base portion 32 such that the displacement thereof is limited by the engagement of the side arms 65 with the walls of the depression 74.

The drive mechanism 60 further includes female shaft 82 having an eccentric pin 84 substantially the same as the female shaft of the previous example. According to the present example however, the female shaft 82 is coupled to the blades mount 65 via a rotating arm 85. The rotating arm 85 is pivotally coupled on a first end thereof to the blades mount 65, for example via a bore 67 defined on the blades mount 65. In addition, the rotating arm 85 is coupled on a second end thereof to the eccentric pin 84 of the female shaft 82.

The bore 67 is disposed on the blades mount 65 shifted from the center thereof, with respect to an axis parallel to the axis of the depression 74, i.e. with respect to the width of the blades mount 65, such that when the rotating arm 85 is rotated the blades mount 65 is urged back and forth along the same axis.

This way, when the female shaft 82 is rotated by the motor, the eccentric pin 84 is rotated about a rotating path, defined on a plan of two axes. Thus, the rotation of eccentric pin 84 urges the rotating arm 85 to rotate therewith, as the eccentric pin 84 is rotated towards the side of the blades mount 65 on which the bore 67 is defined, the blades mount 65 is urged to the opposite direction. This way the eccentric pin 84, the rotating arm 85, and the blades mount 65 provide a rotary to linear motion conversion, in which the rotating motion of the female shaft 82 is converted to a linear motion of the blades mount 65 along the axis of the depression 74.

Figure 5A:
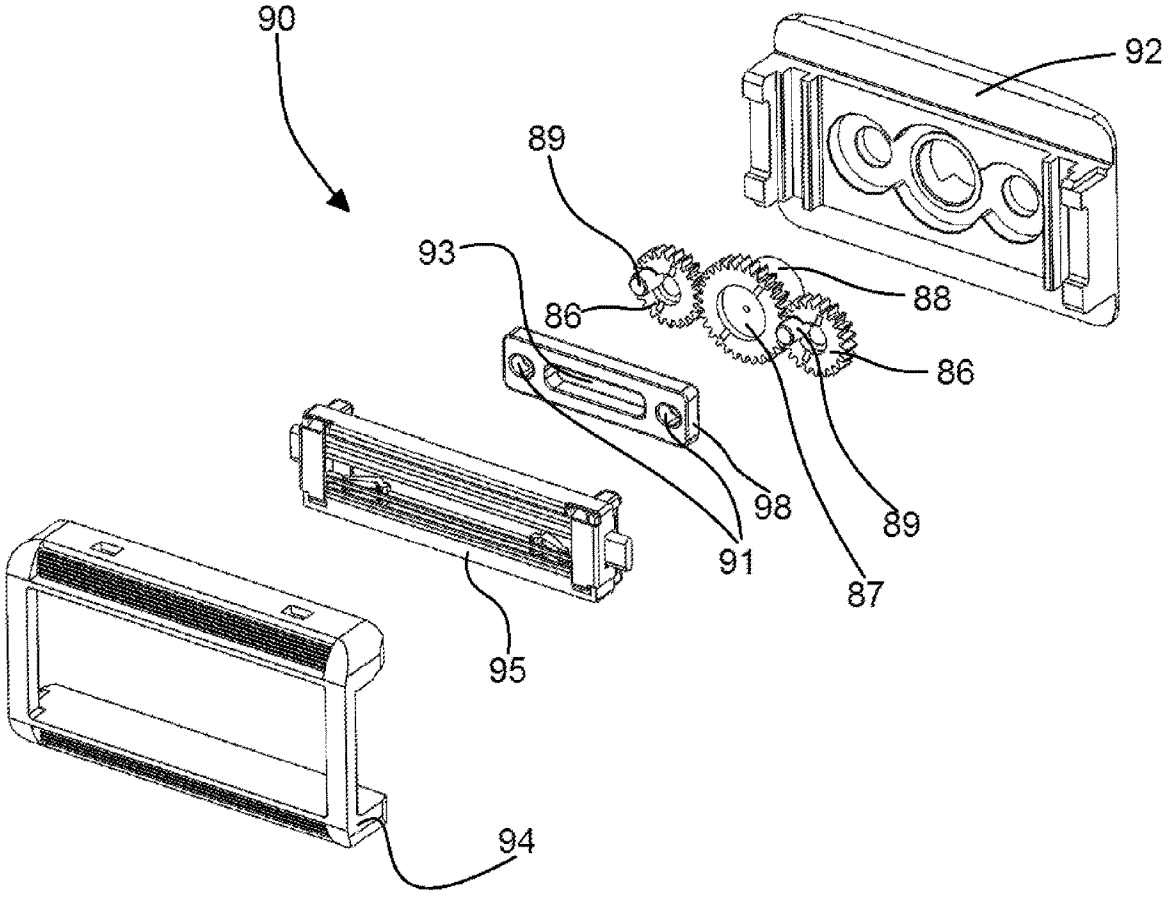
FIG. 5A is top exploded view of the drive mechanism according to another example of the presently disclosed subject matter.
Figure 5B:
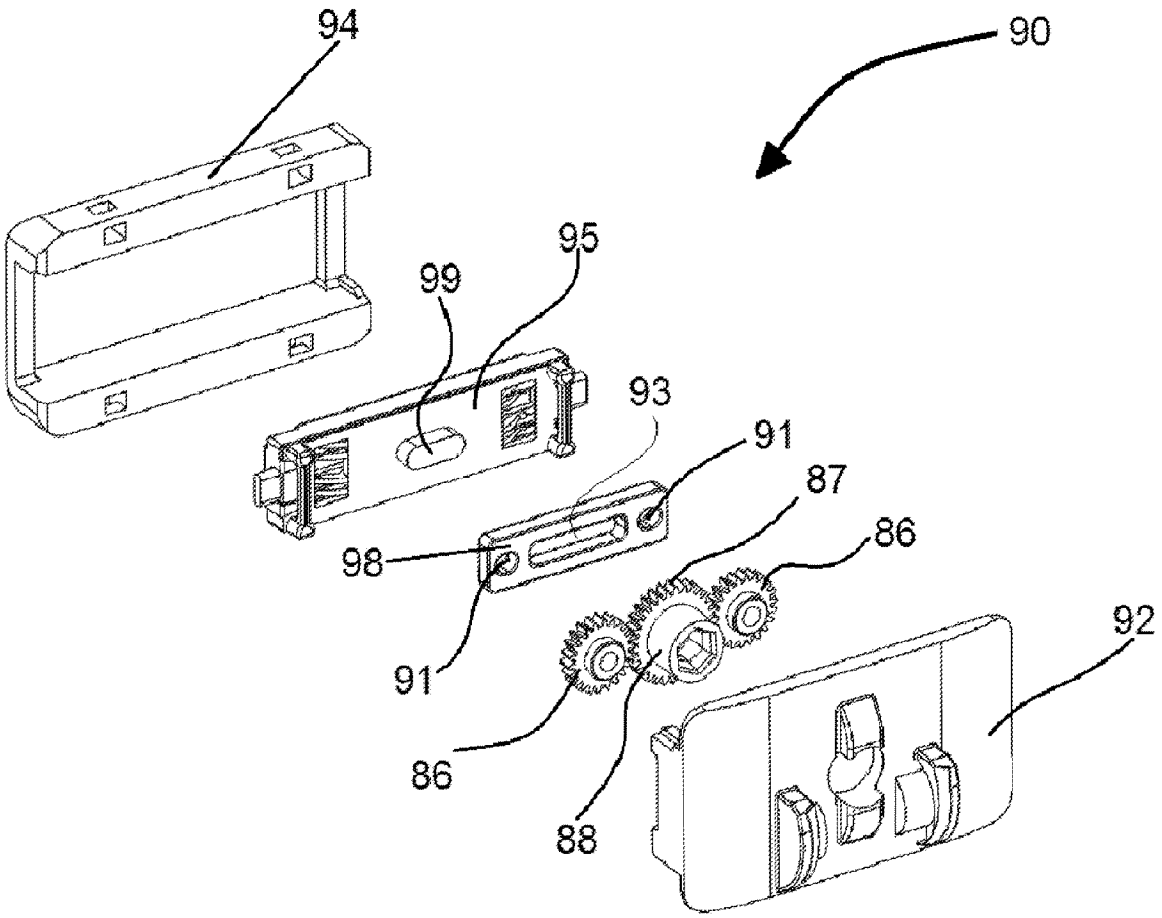
FIG. 5B is bottom exploded view of the drive mechanism of FIG. 5A.

Attention is now made to FIGS. 5A and 5B, showing a drive mechanism 90 according to another example. According to this example the drive mechanism 90 includes a base portion 92, a cover portion 94 configured for engaging the skin surface, and a blades mount 95 slidably mounted on the base portion 92. The drive mechanism 90 further includes a female shaft 88 which, as in the previous examples, includes a seat configured to be coupled to joint (for example joint 25 of FIG. 2B) such that the joint provides a rotating movement to the female shaft 88. The female shaft 88 further includes a cogged portion 87 configured to engage and rotate two side cogwheels 86. Each of the side cogwheels 86 is formed with an eccentric pin 89 the purpose of which is described herein below.

The drive mechanism 90 further includes a sliding member 98 having an elongated aperture 93 configured to allow a corresponding elongated protrusion 99, formed on the bottom of the blades mount 95, to slide therein. It is appreciated that the term bottom in this connection refers to the bottom side of the blades mount 95 when the apparatus 10 is vertically disposed with the shaver head 20 facing up.

The sliding member 98 further includes two bores 91 each formed on one side of the elongated aperture 93 and configured to allow one of the eccentric pin 89 of the cogwheel 86 to rotate therein.

This way, when the female shaft 88 is rotated, rotating the two side cogwheels 86 therewith, the two eccentric pins 89 are rotated about a rotating path, urging thereby the sliding member 98, to be displaced therewith. The engagement of the sliding member 98 and the elongated protrusion 99, however, limits the movement of the sliding member 98 such that it can only slide together with the elongated protrusion 99. It is appreciated that since the eccentric pins 89 are rotated about a rotating path in a close loop the sliding member 98 slides in a reciprocating motion, i.e. back and forth displacement along the elongated protrusion 99.

Accordingly, since the sliding member 98 slides only along one axis, i.e. the axis of the elongated protrusion 99, while the eccentric pins 89 are rotated about a rotating path, defined on a plan of two axes, the rotation of eccentric pins 89 urges the blades mount 95 to be displaced along an axis perpendicular to the axis of the elongated aperture 93. This way the eccentric pins 89, the sliding member 98, and the elongated protrusion 99 of the blades mount 95 provide a rotary to linear motion conversion, in which the rotating motion of the female shaft 88 is converted to a linear motion in two axes, i.e. displacement of sliding member 98 along the axis of the elongated aperture 93, and displacement of the blades mount 95 along a perpendicular axis.

As a result, when the shaving apparatus is activated, the motor rotates the female shaft 88 causing thereby the blades mount 95 to slide back and forth over the base portion 92, such that the first and second blades are displaced back and forth in a harmonic motion. It is appreciated that according to this example the linear motion is smoother and symmetric this is due to the fact that the rotary to linear motion conversion is carried on two sides of the sliding member 98, i.e. the forces exerted on the blades mount 95 are exerted symmetrically.

Figure 6A:
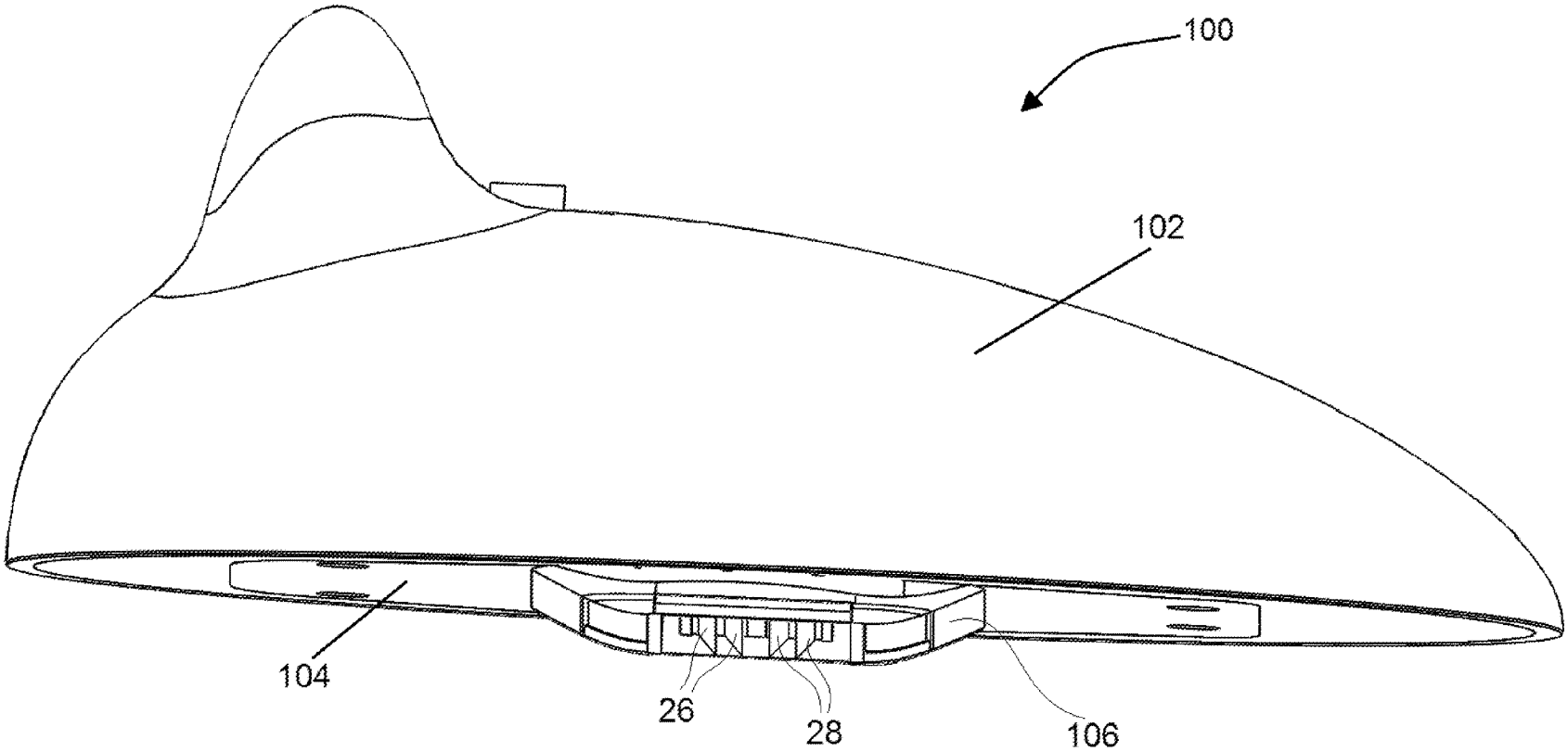
FIG. 6A is a perspective view of a shaving apparatus in accordance with another example of the presently disclosed subject matter.
Figure 6B:
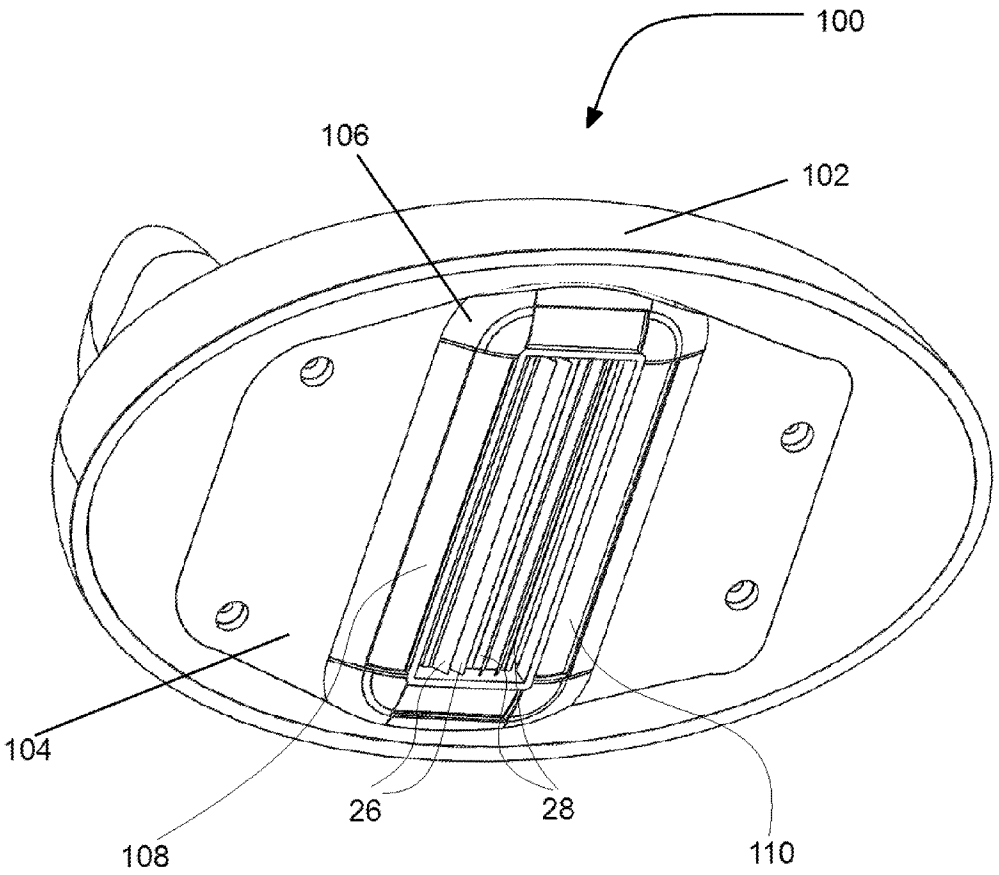
FIG. 6B is a bottom view of the shaving apparatus of FIG. 6A.

FIGS. 6A and 6B illustrate another example of the presently disclosed subject matter. According to the illustrated example, the shaving apparatus 100 includes a housing 102 having an ergonometric surface configured to be held and maneuver by the palm. The shaving apparatus 100 housing includes a bottom portion 104 having a shaver head 106 provided with at least one first blade 26 and at least one second blade 28 mounted to the shaver head 106 and configured to be displaces in an alternating motion between a first and a second direction thereby allowing a bi-directionally shaving hair on said skin surface, substantially the same as in the previous examples. As in the previous examples, the shaver head 106 can include one or more engaging portions 108 and 110 configured to stretch the skin surface facilitating thereby the shaving of hair.

According to an example engaging portion can include a first engaging portion 108 disposed adjacent the first blades 26 and a second engaging portion 110 adjacent second blades 28. The first engaging portion 108 can be configured to provide a lower friction than the second engaging portion 110, such that when the shaver head 106 is slide in a direction of the first engaging the second engaging portion 110 holds the skin in place while the first engaging portion 108 slightly stretches the skin in the direction of the displacement of the shaver head 106. Stretching the skin surface between the first and second engaging portions facilitates the shaving of hair on the skin surface.

Figure 7:
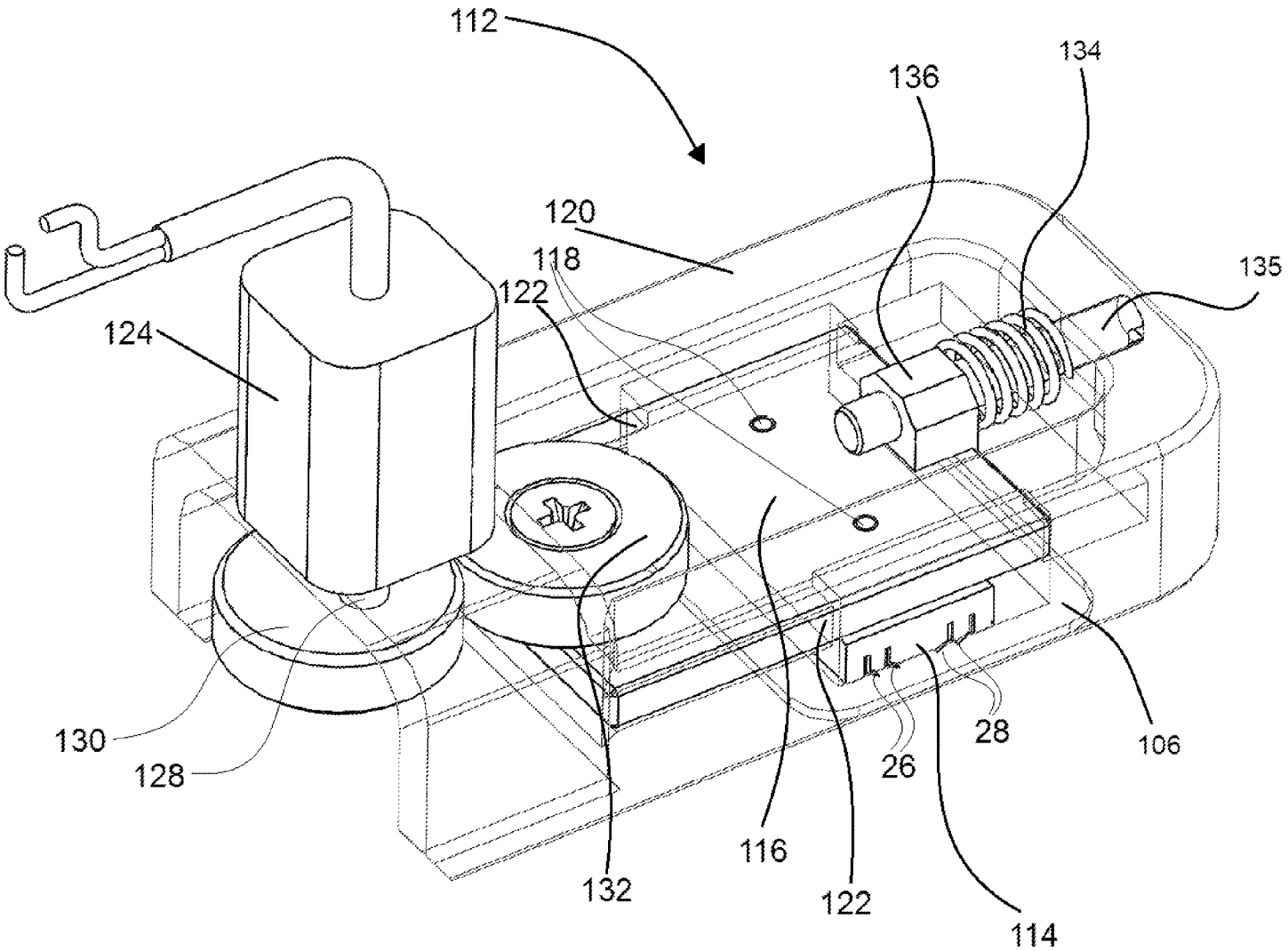
FIG. 7 is a partially transparent perspective view of the driving mechanism of the shaving apparatus of FIG. 6A.

FIG. 7 illustrates an example of a drive mechanism 112 for creating an alternating displacement of the blades 26 and 28 in the shaver head 106 of the shaving apparatus of FIGS. 6A and 6B.

The drive mechanism 112 includes a sliding member 116 to which the opposing blades 26 and 28 are mounted, for example by a blades mount 114 fastened to the sliding member 116 with one or more pins 118. The sliding member 116 is configured to slide between a first direction to which the first blade 26 is directed and a second direction to which the second blade 28 is directed. The blades mount 114 and blades 26 and 28 can be removably mounted to the sliding member 116 such that they can be replaced periodically. The sliding member 116 can be configured to slide along guides 122 in the chassis 120 of the shaver head 106 which is coupled thereto.

The drive mechanism 112 further includes a motor 124 coupled to a power source, and a rotating disk 130 eccentrically coupled to a shaft 128 of the motor 124. The rotating disk 130 is configured to rotate about an axis parallel to the axis of the shaft 128, such that when the shaft 128 is rotated the rotating disk 130 is displaced along a rotational path.

In addition, the drive mechanism 112 includes a bearing 132 engaged with a first end of the sliding member 116 and an abutting member 136 engaged a second end of the sliding member 116. The abutting member 136 is biased by a spring 134, such that the sliding member 116 tends to be slid towards the bearing 132.

According to an example, the force exerted by the spring 134 can be set by an adjusting screw 135, such that the harmonic displacement of the sliding member 116 is adjusted as desired, e.g. the amplitude of the displacement is set.

The periphery of the rotating disk 130 is engaged with the bearing 132 such that when rotating disk 130 is rotated along the rotational path, the bearing 132 is pushed by the rotating disk 130 together with the sliding member 116 towards the abutting member 136. Thus, the spring biased abutting member 136 and the displacement of the rotating disk 130 causes a back and forth motion of the sliding member 116 between the first direction, i.e. the bearing 132, and a second direction, i.e. the abutting member 136.

The sliding member 116 on which the first and second blades 26 and 28 are mounted reciprocally slide the first and second blades 26 and 28 in an alternating motion between the first direction and the second direction thereby allowing a bi-directionally shaving hair on the skin surface, while the shaving apparatus 100 is displaced in one directionally over the skin surface. It is appreciated that the harmonic motion of the first and second blades 26 and 28 can be carried by utilizing electronic means or other means rather than mechanical means. For example, the shaver had can include electro-magnetic elements configured to urge the blades to be displaced in harmonic motion. Those skilled in the art to which the presently disclosed subject matter pertains will readily appreciate that numerous changes, variations, and modifications can be made without departing from the scope of the invention, mutatis mutandis.

The invention claimed is:

1. A shaving apparatus for shaving hair on a skin surface, the apparatus comprising:

a housing having a motor encased therein;

a shaver head articulately coupled to said housing by a joint configured for tilting of said shaver head with respect to said housing and said motor and further configured for continuously transferring a rotational motion from said motor to said shaver head, said shaver head having at least one first blade mounted a first angle with respect to said shaver head and being configured to shave hair on a skin surface during displacement of said shaver head in a first direction along said skin surface, and at least one second blade mounted a second angle with respect to said shaver head and being configured to shave hair on said skin surface during displacement of said shaver head in a second direction along said skin surface, wherein said first angle and said second angle are opposing angles; and a drive mounted on said shaver head;

and configured to translate said rotational motion to a linear motion and to reciprocally slide said first and second blades in an alternating motion between said first direction and said second direction thereby allowing a bi-directionally shaving hair on said skin surface.

2. The shaving apparatus according to claim 1 wherein said joint includes a flexible cable shaft coupling said motor to said drive.

3. The shaving apparatus according to claim 2 wherein said flexible cable shaft is coupled to a motor encased in a housing and wherein said shaver head is articulately coupled to said housing by a joint including a hexagonal surface having a plurality of facets, configured to engage a corresponding seat on said shaver head, such that rotation of said flexible cable shaft causes the rotation of said seat, while allowing tilting of said shaver head with respect to said housing.

4. The shaving apparatus according to claim 3 wherein said drive includes a drive mechanism configured for rotary to linear motion conversion, and for reciprocally displacing said blades back and forth.

5. The shaving apparatus according to claim 4 wherein said drive mechanism includes a base portion, and a blades mount configured for mounting thereon said first and second blades wherein said blade mount is configured to slide back and forth over said base portion along a first axis, and wherein said blade mount is eccentrically coupled to a rotating shaft.

6. The shaving apparatus according to claim 5 wherein said rotating shaft is coupled to said joint and includes an eccentric pin rotationally coupled to said blade mount, wherein said eccentric pin is defined on an axis parallel to an axis of said joint such that while said joint is rotated, said eccentric pin is displaced about a rotating path.

7. The shaving apparatus according to claim 6 wherein said blades mount includes a groove defined along a second axis perpendicular to said first axis and a sliding member slidably mounted inside said groove, wherein said sliding member is coupled to said eccentric pin of said rotating shaft, such that when said eccentric pin is rotated about along said rotating path said sliding member is urged to be displaced therewith along said second axis and said blades mount is urged be displaced along said first axis.

8. The shaving apparatus according to claim 6 wherein said blades mount is coupled to said eccentric pin by a rotating arm wherein said rotating arm is coupled to said blades mount at a location shifted from the center thereof, with respect to said first axis such that when the rotating arm is rotated said blades mount is urged back and forth along said first axis.

9. The shaving apparatus according to claim 6 wherein said driving mechanism includes a sliding member having a groove defined along a second axis perpendicular to said first axis, wherein said blades mount includes a protrusion slidably mounted inside said groove, and wherein said sliding member is coupled to said eccentric pin of said rotating shaft, such that when said eccentric pin is rotated about along said rotating path said sliding member is urged to be displaced therewith along said second axis and said blades mount is urged be displaced along said first axis.

10. The shaving apparatus according to claim 9 wherein said eccentric pin includes a first and a second eccentric pins, wherein said first eccentric pin defined on a first side cogwheel and being coupled to a first side of said sliding member, and a second eccentric pin defined on a second side cogwheel and being coupled to a second side of said sliding member, wherein said first side and second side are defined along said second axis.

11. The shaving apparatus according to claim 10 wherein said first and second side cogwheels are simultaneously rotated by a rotating shaft having a cogged portion.

12. The shaving apparatus according to claim 5 wherein said drive mechanism includes:

a sliding member on which said first and second blade are mounted, said sliding member is configured to slide between said first direction and said second direction;

a rotating disk eccentrically coupled to a shaft of a motor such that when the shaft is rotated the rotating disk is displaced along a rotational path;

a bearing engaged with a first end of said sliding member and with a periphery of said rotating disk wherein said periphery is defined at varying distances from said shaft, such that when said rotating disk is rotated along said rotating path, said bearing is pushed in a first direction towards said sliding member;

an abutting member engaged with a second end of said sliding member and configured to urge said sliding member in a second direction opposite said first direction, such that said sliding member is slid back and forth.

13. The shaving apparatus according to claim 3 wherein said housing having an ergonometric surface configured a palm grip.

14. The shaving apparatus according to claim 2 wherein said shaver head includes an engaging portion configured to engage a skin surface while the drive mechanism displaces said first and second blades back and forth, such that said skin surface is held in place, with respect to said shaver head.

15. The shaving apparatus according to claim 14 wherein said engaging portion includes a strip defined on an outer surface of said shaver head alongside said first and second blades such that said strip is engaged with the skin surface while shaving.

16. The shaving apparatus according to claim 15 wherein said engaging portion includes a first engaging portion disposed adjacent said first blades and a second engaging portion disposed adjacent said second blades.

17. The shaving apparatus according to claim 16 wherein said first engaging portion is configured to provide a lower friction than said second engaging portion, such that when said shaver head is slid in a direction of said first engaging portion said second engaging portion holds the skin surface in place while said first engaging portion stretches the skin in said direction of displacement of said shaver head.

18. The shaving apparatus according to claim 2 wherein said at least one first blade includes two first blades and at least one second blade includes two second blades, wherein said two first blades and two second blades are mounted on a blade mount configured to slide back and forth with respect to said shaver head.

19. The shaving apparatus according to claim 18 wherein a longitudinal edge of said first blades and of said second blades defines a shaving surface and wherein said first blades and said second blades are mounted at opposing angles with respect to said shaving surface.

20. The shaving apparatus according to claim 19 wherein said first and second blades are disposed in parallel to one another and are set such that the blade edges thereof are facing one another.

21. The shaving apparatus according to claim 19 wherein said first and second blades are disposed in parallel to one another and are set such that the blade edges thereof are opposing one another.

22. The shaving apparatus according to claim 1 wherein properties of said alternating motion are adjusted in accordance with characteristics of the hair.

* * * * *